United States Patent [19]

Hester, II

[11] Patent Number: 5,044,888

[45] Date of Patent: Sep. 3, 1991

[54] VARIABLE SPEED PUMP CONTROL FOR MAINTAINING FLUID LEVEL BELOW FULL BARREL LEVEL

[75] Inventor: Lawrence R. Hester, II, Sachse, Tex.

[73] Assignee: Teledyne Industries, Inc., Garland, Tex.

[21] Appl. No.: 309,702

[22] Filed: Feb. 10, 1989

[51] Int. Cl.[5] ..... F04B 49/00

[52] U.S. Cl. ..... 417/22; 417/45; 417/53

[58] Field of Search ..... 417/22, 45, 53

[56] References Cited

U.S. PATENT DOCUMENTS

| | | |
|---|---|---|
| 3,951,209 | 4/1976 | Gibbs . |
| 4,015,469 | 4/1977 | Womack et al. . |
| 4,034,808 | 7/1977 | Patterson . |
| 4,058,757 | 11/1977 | Welton et al. . |
| 4,145,161 | 3/1979 | Skinner . |

*Primary Examiner*—Leonard E. Smith
*Assistant Examiner*—David W. Scheuermann
*Attorney, Agent, or Firm*—John F. Booth

[57] ABSTRACT

A variable speed pump control system and method which senses operational parameters during the first one half of the down stroke to control pump speed to maximize production. The method and equipment maintains ths fluid level of a well as low as possible while avoiding the pump-off condition. A variable speed motor drives a pump jack and a control means varies the pump speed. Means are provided for simultaneously sensing the pump speed, load on the rod, and the position of the rod in the pump stroke. These measurements are utilized to calculate the power transferred between the rod string and the beam during a portion of the downstroke. Before the pump is continuously operated, a series of measurements are made in the full barrel pumping condition to determine the power transferred between the rod and beam at various speeds. These are utilized to establish a relationship between pump speed and power during a portion of the downstroke. The well is operated and the measured values obtained during pumping are compared to the established relationship between pump speed and power. The pump speed is varied according the established relationship to power to optimize the fluid level in the well.

15 Claims, 5 Drawing Sheets

VARIABLE SPEED PUMP CONTROL FOR MAINTAINING FLUID LEVEL BELOW FULL BARREL LEVEL

BACKGROUND OF THE INVENTION

The most commonly used method for production by artificial lift is use of a pump jack—rod pumping system. In rod pumping, a pump jack is used to vertically reciprocate a rod extending down to the production zone of the well. The rod is connected to a subsurface pumping unit which consists of a piston in a pump barrel connected to the rod to reciprocate within the barrel and lift the fluid. The dependability and economy of these pump jack systems makes these systems highly desirable and generally used.

In the design of these systems, it is generally accepted that the capacity of the pumping system will exceed the maximum production of the oil well as the production rate declines. As a result, if the systems are operated at maximum capacity, the system will become what is known in the industry as "pumped-off," reducing the efficiency of this system due to a partially filled condition in the barrel. The partially filled pump barrel is caused by the pump removing liquid faster than the well produces. In addition, the pumped-off condition can result in damage to the rod string and pump.

As a consequence, control systems are currently available for detecting the pumped-off condition and for controlling the operation of the pump in response to detection of this condition. The history of the development of various of control systems is outlined in the 1977 Society of Petroleum Engineers of AIME Paper entitled "Successful Application of Pump-Off Controllers SPE No. 6853." As is pointed out therein, a development of generally applicable pump-off control methods was complicated by pumping abnormalities not associated with pump-off such as gas interference, harmonic pumping speeds, down-hole friction, equipment vibrations, corrosion, changes in the reservoir performance and the like. Historically, attempts to solve the varied problems of an efficient pump-off control has taken on many forms.

The initial efforts to control pump-off are basically an attempt by a pump operator to match the pumping speed to the production rate of the well or reservoir. However, in order to obtain maximum production from the well, it is generally necessary to maintain the lowest possible fluid level in the well, and therefore the lowest possible back pressure on the formation. In order to assure a low average fluid level, it is necessary to provide a pumping system with a capacity in excess of the productive capacity of the well. The excess pumping capacity required to maintain the low fluid level ensures that pump-off will occur unless the pump is controlled in some manner. The first effort made to deal with the pump-off problem was to manually start and stop operation of the pumping system. In this approach the lease operator would estimate the amount of pumping time required to obtain maximum production from the well and maintain the fluid level as low as possible. This approach required a pumper periodically to turn the well pump off and on to regulate the pumping operation. This method suffered from the disadvantage of being less than exact and labor intense.

The first attempts to automatically control the operation of the pumping system were to install timers which automatically stopped and started the operation of the pumping system. For example, the time clocks would automatically operate the pump for a period of time every hour. Again, these systems suffered from the disadvantage of being inexact in that the operator was required to estimate the amount of pump operation which would maximize production. The tendency, of course, in these time systems was to over pump the well to assure not missing any fluids, thereby causing the inherent production maintenance problems.

As a result of the inaccuracies inherent in a system which estimate fluid level, methods have been developed for analyzing the loading on the pump rod to determine when the pump-off condition occurs. Since rod loading is directly affected by the pump loading, a number of characteristics of the rod loading can be used to detect pump-off of a well. Various portions of the rod load versus position relationship of a well has been utilized to sense pump-off. One example of such a system is found in the U.S. Pat. No. 3,951,209 to Gibbs issued Apr. 20, 1976 entitled "Method For Determining The Pump-Off Of A Well." In this method, a dynamometer is used to monitor the total power input to the rod string to sense when power input decreases to determine when the well pump-off occurs. This system determines the power input to the well pump by integrating the rod load as a function of displacement. When the actual horse power input to the top of the rod string falls below a set minimum, a computer can be utilized to transmit a signal which stops the pumping unit for a period of time. This system is sometimes called an on-off pump-off control in that the system senses the pump-off condition and terminates the pumping operation for a period of time. However, in this type of system, the pumping rate has to be set to exceed the production rate of the well. The system operates by pumping until the pump-off condition is reached and shutting pumping operations down until fluid re-accumulates in the well. However, as was previously pointed out for maximizing production, the fluid level in the well needs to be maintained as possible without reaching a pump-off condition. And thus during that period of time, when the pump is not operated and fluid is flowing from the formation into the well, production will be lost because the fluid level is at too high a level. Even though the Gibbs patent suggests that a computer can be used to constantly monitor and adjust the shut-in periods to minimize the loss of production, the system does not provide a means for maintaining the most efficient fluid level for purposes of production.

Two later patents provide variations of the on-off system taught in the Gibbs patent. The first is U.S. Pat. No. 4,015,469 to Womack, issued Apr. 5, 1977 entitled "Pump-Off Monitor For Rod Pump Wells." In the Womack patent the same off-on method is used, however, the method of determining when pump-off has occurred is somewhat refined. In Womack. instead of integrating the power over the entire stroke, only the power input during a portion of the stroke is considered. In this patent, Womack suggests that a considerable difference in energy input between the pumped-off and normal pumping condition can be found in the last quarter of the upstroke and the first quarter of the downstroke. As Womack points out, the difference between the energy input for the pumping condition and the energy for the pumped-off condition is usually only five to fifteen percent of the total power input and that errors in the measurement of the load of the rod string or displacement of the rod string can produce an error in the final results which may prevent sensing of the pumped-off condition by measuring only a portion of the stroke. Womack attempts to overcome problems present in an on-off system which compares against a set point to determine pump-off.

The second variation of Gibbs is found in the U.S. Pat. to Patterson No. 4,034,808 issued July 12, 1977 entitled "Method For Pump-Off Detection." Patterson likewise uses an on-off system and utilizes rod performance during only a portion of the pump's cycle to sense the pumped-off condition. Patterson suggests using only the first quarter of the downstroke of the differences in energy between the pumped-off condition and the pumping condition are substantial. Patterson utilizes this portion of the pump stroke to determine whether or not the pumped-off condition is present to shut the system off.

These on-off systems suffer from the disadvantage of inhibiting well production during the shut-down period and also require that the system reach the inherently damaging pump-off condition before the pump operation is controlled.

One attempt has been made to dynamically control the fluid level in the well and maximize production. That system is described in the U.S. Patent to David Skinner. No. 4,145,161, issued in 1977 entitled "Speed Control." This system utilizes a variable speed controller and electric motor to continuously control the rate of removal of fluid from the well. The Skinner system measures the total electrical power supplied to the pump motor and regulates the pump motor speed based upon the fact that as fluid level decreases the total power increases. To implement the system, Skinner pumps the well down at a predetermined speed and monitors the total electrical power supplied as the well pumps down. When the well becomes pumped-off, the proportionality between the power and speed can be determined and set for a point before pump-off establishing a proportionally constant to be used in operating that particular well. This method leaves three major shortcomings when in actual use. The first is that it has been found that the so-called proportionality constant is not in fact a constant over the pumping rates and is rather a relationship whose proportion varies with speed. When Skinner assumes that the relationship is a constant, error is inescapable. Skinner recognizes this problem and suggests avoiding selecting a point too close to pump-off without informing a person of skill how to avoid being too close or even how to tell when one is too close. Second, Skinner controls directly proportional to fluid height above full barrel. Skinner is incapable of controlling in the more effective range of fluid height between pump-off and full barrel. Finally, Skinner's system is subject to errors induced by changes in system supply voltage.

BRIEF DESCRIPTION OF THE INVENTION

The present invention improves the method and equipment for maintaining the fluid level of a well as low as possible while avoiding pump-off. The invention utilizes a variable speed motor to drive a pump jack and control means for varying the speed of the pump. Means are provided for simultaneously sensing the pump speed, load on the rod and the position of the rod in the pump stroke. During operation, these measurements are utilized to calculate the power transferred between the rod string and the beam during a portion of the down stroke. Calculating the power only during the downstroke is performed because during the downstroke the inflowing fluid column is separated from the pump and the rod string by the standing valve at the bottom of the pump and in this portion of the stroke, the differences between a full pump and the pumped-off condition are the largest. Before the pump is continuously operated, a series of power measurements are made in the full barrel pumping states to determine the power transferred between the rod and beam at various speeds. These are utilized to establish a relationship (not necessarily linear) which is later used to control the well. The well is then operated and the values obtained during pumping are compared to the relationship to correct the well during operation. In this manner, variations in the proportionality constant as a function of speed are taken into consideration to accurately control the well to operate at an effective fluid height over a range of fluid production rates.

BRIEF DESCRIPTION OF THE DRAWINGS

The present invention will be more easily understood from the following detailed description of a preferred embodiment when taken in conjunction with the attached drawings and which.

DESCRIPTION OF THE PREFERRED EMBODIMENT

Figure 1:
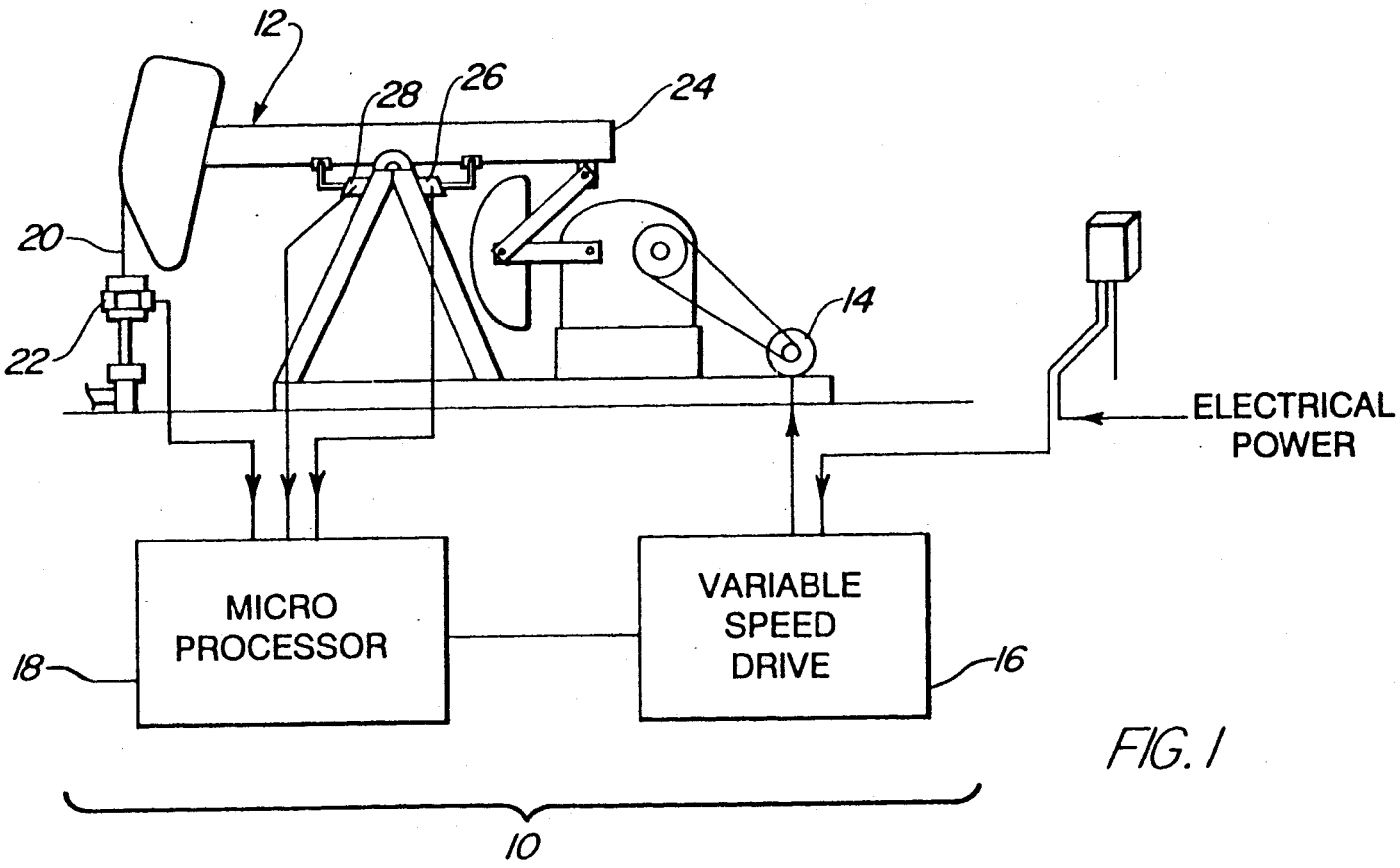
FIG. 1 is a schematic view of the elements of the present invention attached to an oil well pumping unit.

Referring now to the drawings wherein like reference characters will be used throughout the several views to refer to like or corresponding parts there is shown in FIG. 1 the improved oil well pumping control system of the present invention which, for purposes of description, is identified by reference numeral 10. System 10 uses a pumping unit 12 which is driven by an electric motor 14. A conventional variable speed motor controller 16 is connected to the electric motor 14 whereby the speed of the motor 14 and pumping rate of the pumping assembly 12 can be varied by the motor controller 16. A master controller 18 is coupled to the variable speed motor controller and pump assembly 12. As will be described in more detail, a master controller 18 receives data relating to the load on the pumping rod as a function of the position of the beam in the pumping stroke and the master controller, in turn, sends control signals to the variable speed motor controller to vary the pumping rate to maximize production.

Data relating to the load on the pump rod string 20 can be obtained through use of a conventional load transducer 22 such as a strain gauge or the like. Data relating to position of the beam 24 can be obtained through a position transducer 26 such as a potentiometer or the like connected to the beam 24. Data relating to the speed of the pump stroke can be obtained through use of a conventional pump stroke speed sensor 28 which could be connected, for example, to the beam 24. In addition, the data can be coupled to the motor controller 16 and transducers 22 and 26 by a cable link in which case the central controller can be remotely located and used to control the operation of more than one pump at a time.

Power transferred between the rod 20 and beam 24 during a portion of the pump cycle can be calculated from the measurements taken by the transducers. The variable speed motor controller 16 is of a conventional construction and operates to vary motor 14 speed by varying the line frequency of the power supplied to the motor 14 as a function of data received from master controller 18. Master controller 18 also contains a conventional on-off control which likewise operates to start and stop motor 14 as a function of data received from master controller 18. Variable speed motor controller of this type are conventional in construction and readily available from numerous manufacturers.

Master controller 18 comprises a microprocessor based controller using STD BUS construction, manufactured by Pro-Log Corporation, 2560 Garden Road, Monterrey, Calif. 93940, Cards Part #7890-07, 7717-02, 7714A-01, 7715A-03, 7507, 7316-04, 7907A and Analog Devices, One Technology Way, Norwood, Mass., Card Part #RTI-1281 are present and connected in a conventional manner to receive analog data from transducers 22 and 26 and supply an analog control signal to motor controller 16 as will be described in detail. Microprocessor based controller can also be obtained form other sources such as WinSystems, Inc., Arlington, Tex., and their assembly and connection to receive analog data and provide analog output is well known to persons who are skilled in the art.

Figure 2:
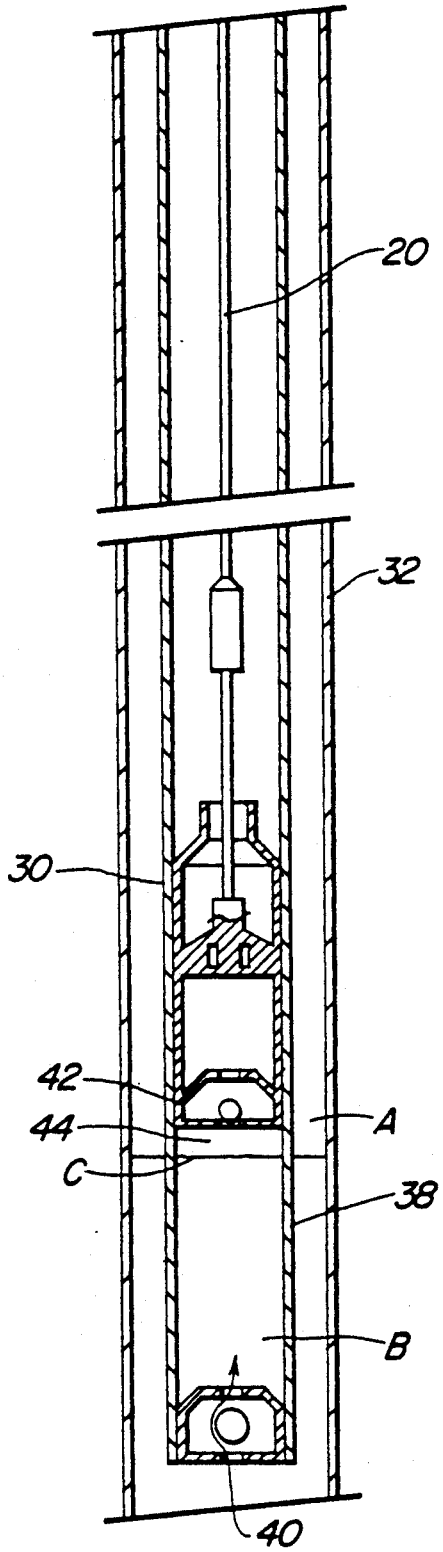
FIG. 2 is a schematic view of a down hole oil field pump.

In FIG. 2, a down-hole oil well pump 30 is illustrated schematically in a perforated casing 32 positioned in a producing formation 34. Positioned inside the casing 32 is a vertical reciprocal pump piston 36 in sliding sealing engagement with the walls of a pump barrel 38. Piston 36 is illustrated at the upper extent of its travel or top dead center and is connected to rod 20. Piston 36 is reciprocated vertically between levels "A" and "B." A standing check valve 40 permits flow only from the casing 32 into the pump barrel 38. A second check valve 42 permits flow only from below to above the piston 36. In operation on the down stroke of piston 36 from position "A" to "B," fluid trapped in the barrel below the piston will be pumped above the piston through valve 42. On the up stroke from position "B" to "A" fluid above, the piston is lifted while fluid flows into the barrel through check valve 40.

The pumped off state occurs when the pump operates at a rate so that the fluid entering the pump barrel during the up stroke reaches approximately only to level "B." In this condition, on the down stroke the piston undesirably will be forced downward by the weight of the liquid supported above the piston and no pumping will occur.

If the pump is operating at a rate whereby the fluid removal rate is less than the rate fluid is flowing into the case from the formation, fluid will undesirably accumulate in the case above the full barrel level "A." Fluid buildup of this type increases pressure on the formation and retards production. Ideally. for maximum production fluid buildup in the casing should be minimized.

It has been found that the pump can be best controlled and the fluid buildup can be minimized if the fluid flows into the barrel at a rate such that the fluid level approaches but does not exceed the full barrel height "A." Level "C" illustrates this ideal level for production and control, with the pump piston shown with a small gaseous volume 44 present below the piston at top dead center position. This optimization is believed to be partially due to the fact that because the pump is operated in a slightly starved condition, fluid buildup is minimized (and partially) because production of the well pump is more accurate when operated below full barrel.

It has been found when the fluid level in the pump barrel is below the full barrel level "A" but above the pump off level "B" total power transferred between the rod 20 and beam 24 varies more during the down stroke. This difference is even greater during the first half of the down stroke. As the fluid level falls below full barrel, the absolute value of the total power transferred between the beam and rod during this portion of the down stroke increases. Other measurable parameters of the degree of pump off (such as load on the rod or beam, work performed by the rod or beam, motor power. etc.) vary similarly during this portion of the stroke. It is to be understood that using power measurement is preferred, however, other parameters could be used to control pump down in accordance with the teaching of the present invention.

Figure 3:
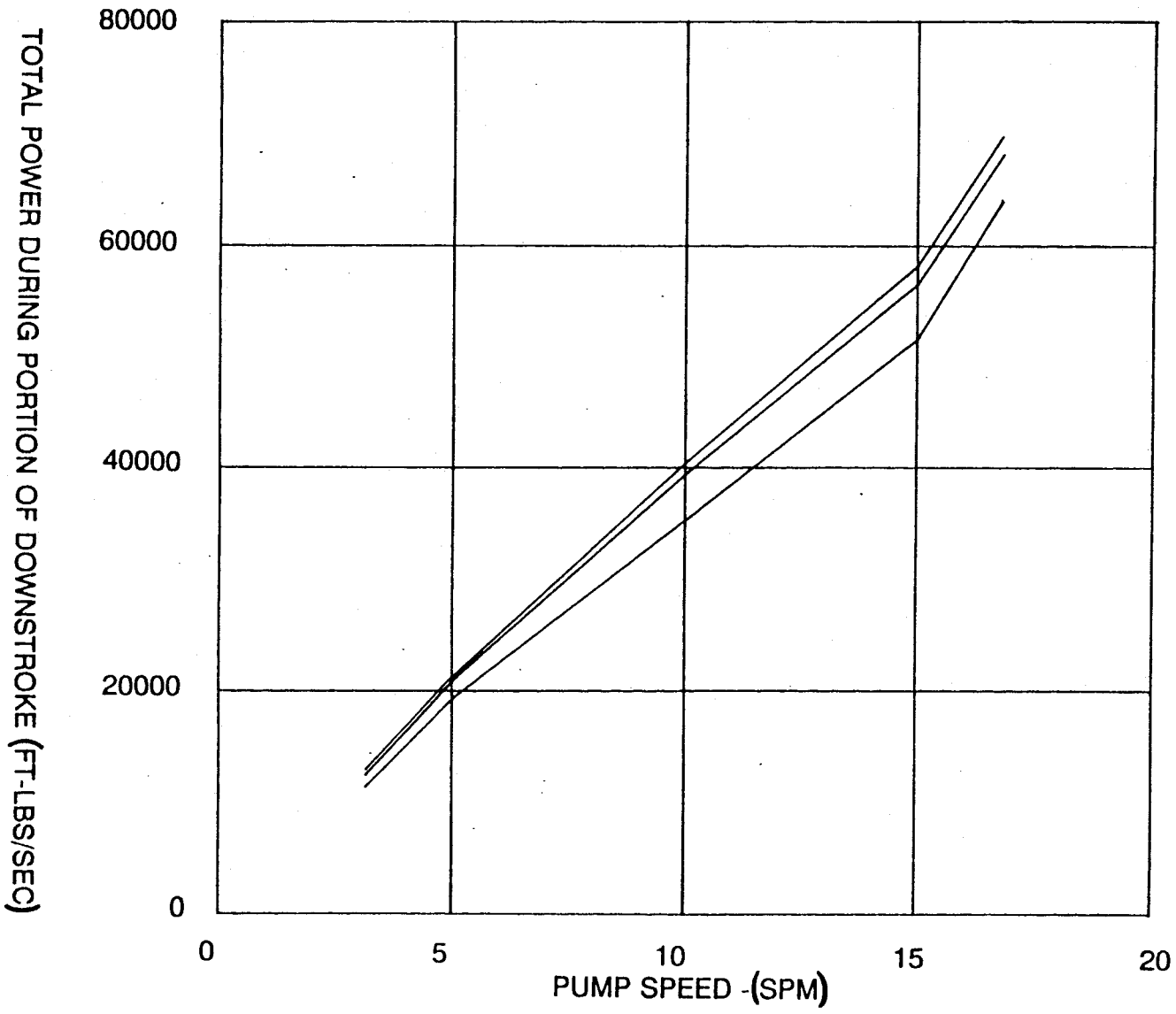
FIG. 3 is an exemplary plot of absolute value of power transferred to the rod as a function of pump speed.

FIG. 3 illustrates a sample graph for a well showing the relationship between total power transferred between rod and beam during a portion of the down stroke as a function of speed. In the graph, the Y axis represents the power transferred and the X axis represents pump speed. The relationship of these variables for a given well at full barrel fluid levels, i.e., those at or above "A" in FIG. 2, is shown as plot A'. It is readily apparent that the relationship shown as A' is not linear. The power values were determined by totaling the power during the portion of the pump cycle from 190° to 240° past bottom dead center. Plot C' estimates the relationship for a fluid level C of FIG. 2 below full barrel (A in FIG. 2) but above pump off (B in FIG. 3). As can be seen by comparing the plots A' and C' at a given speed, the power transferred between the rod and beam during a portion of the down stroke increases as the fluid level drops from level A to C. As will be described in detail, the non linear relationship of speed versus power of plot C' can be used to control the well pump speed to maximize production.

For an existing producing well determining the relationship shown by plot C' is premature. However, plot A' can be easily determined by varying the pumping speed in a full bore condition and calculating the corresponding power transferred. From this relationship, plot C' can be calculated by increasing the power values by a uniform percentage, for example, ten percent over the range of motor speeds. As will be described in detail, the relationship represented by plot C' of FIG. 3 can be used as a basis for varying the motor speed (and pumping cycle speed) to maximize production by maintaining the fluid level in the barrel below full barrel, such as shown as level C in FIG. 2.

To accomplish the method of the present invention, the power to speed relationship must first be determined for a given well. The method steps of start up are shown in FIG. 4.

Figure 4:
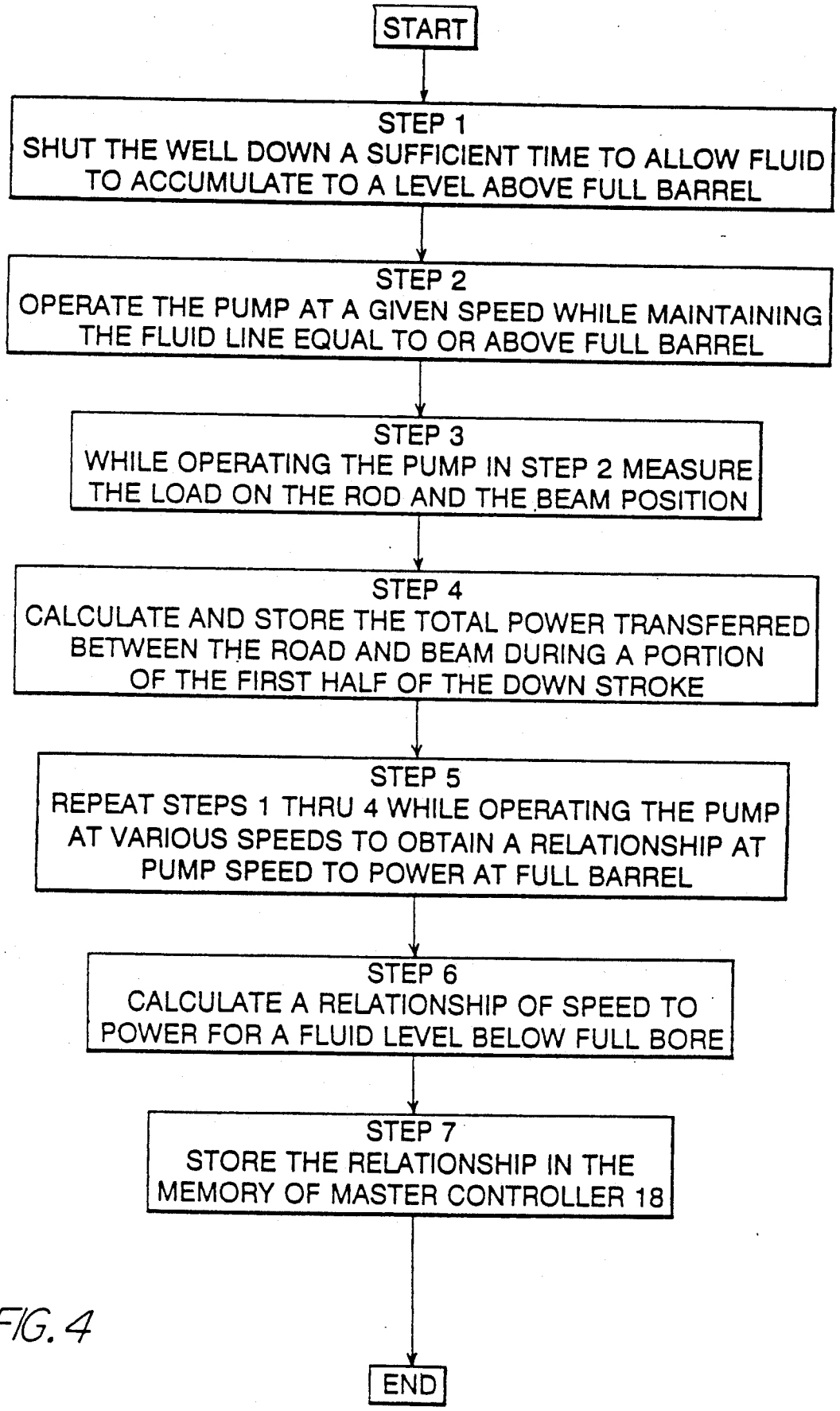
FIG. 4 is a flow diagram of the setup method of determining the control relationship.

Referring to FIG. 4, the method steps of setting up a well for use with the improved pumping system of the present invention are shown. Set up method is utilized to determine the characteristic relationship of a given well full bore power to speed. Before beginning, the improved pumping system of the present invention is assembled as shown in FIG. 1.

In the first step shown in FIG. 4, pumping of the well is temporarily stopped so that the well can be shut down a sufficient time to allow fluid to flow from the formation into the annulus and to accumulate to a level above full bore. It is best to allow the fluid to accumulate in this first step to a sufficient height so that the fluid level will remain above full barrel during the performance of the steps of the set up method.

Once fluid has sufficiently accumulated in the pump, the pump is operated at a set speed and the system is allowed to stabilize for a short period of time. While operating the pump in the stable condition of Step 2, the load on the rod is measured and the beam position is simultaneously measured by use of the transducers 22 and 26 shown in FIG. 1. This data is transmitted to the master controller and the master controller is suitably programmed to calculate and store the total power transferred between the rod and the beam during only a portion of the first half of the down stroke. Preferably, the total power is calculated for a portion of the stroke between 190° and 240° following top dead center. According to a method of the present invention, an average can be determined and stored corresponding to the pump speed.

In Step 5, Steps 1 through 4 are repeated while operating the pump at various speeds to obtain a relationship of pump speed to power in the full barrel condition.

In Step 6, the values obtained in Steps 1 through 5 are utilized to calculate a relationship of speed to power for an optimum fluid level below full bore by increasing the power values by a uniform percentage. For example, the power values obtained in Steps 1 through 5 may be increased by ten percent over the range of motor speeds. As the fluid level falls below full barrel, the absolute value of the total power transferred between the beam and rod during the down stroke increases. Therefore, operating the pump at a speed that results in total power values slightly greater than those obtained in Steps 1 through 5 for a full barrel will result in the pump being operated in a slightly starved condition. Production from the well is maximized when the pump is operated at a speed to control the rate of fluid flow into the barrel such that the fluid level approaches but does not exceed full barrel.

In Step 7, this relationship for an optimum fluid level is stored in memory in the master controller 18. Once the set up method, illustrated in FIG. 4, is completed, operation of the improved pumping system of the present invention can begin.

Figure 5:
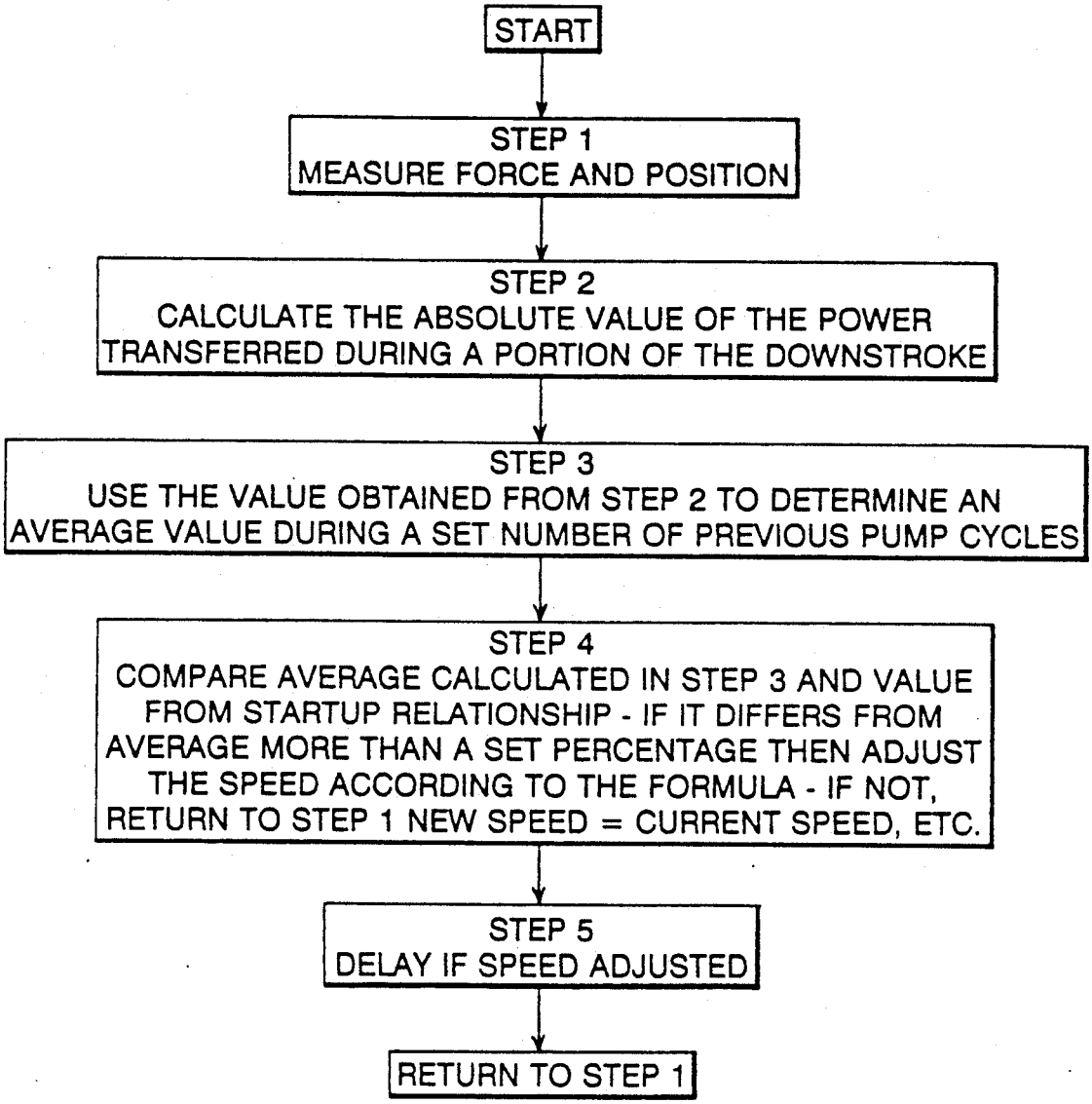
FIG. 5 is a flow diagram of the pump control method.

In FIG. 5, the method steps of the control method for operating the improved pumping system of the present invention is schematically illustrated. In operation, variable speed motor controller 16 starts the electric motor 14, actuating the pumping assembly 12 at a preselected speed. While operating the well at the preselected speed, transducers 22 and 26 continuously measure the force transfer between the beam 24 and rod 20 in the position of the beam 24.

In FIG. 5, Step 1 is shown as measuring the force on the rod 20 and position of the beam 24. [These measurements can be selective or continuous depending on whether or not the operator desires to use these measurements for additional control functions other than controlling the optimum production speed of the well pump.]

In Step 2, the master controller 18 has been programmed to calculate the absolute value of the power transferred between the pump and the rod during a portion of the down stroke. The portion of the down stroke selected should be identical to that selected during the setup method and in the illustrated example is from 190° to 240° after bottom dead center.

In Step 3, the power value is obtained from Step 2 and is used to obtain a moving average value of the power transferred during a set number of previous pump cycles. For example, if the operator desires the system to be quickly responsive, the average could be determined over only one of the previous strokes and if the operator wishes the system to respond more slowly, the average could be determined over a larger number of cycles.

In Step 4, the average determined in Step 3 is compared to the power value at that motor speed in the stored relationship determined during the startup method If the power for that speed differs from the average more than a set percentage—say, for example, two percent—than the speed will be adjusted according to a formula. If the power value does not differ more than two percent, the system would return to Step 1 and begin the process anew.

The formula for determining the new speed is as follows:

New speed = Current speed − (Current Speed *(Ave. calculated Power − Power Curve Value)/Average Calculated Power)* Gain/100.

Once the new speed is calculated, a control signal is sent to the motor controller 16 which, in turn, adjusts the motor speed accordingly.

In Step 5, a delay can be taken before returning to Step 1 if the speed has been has been adjusted whereby the system is allowed to reach a steady state condition. After the delay, the system would return to Step 1 and begin the system analysis again.

Although not illustrated in FIG. 5, it is to be understood of course that load and position measurements could also be sensed to determine whether or not various malfunctions have occurred in the system. For example, if during the pumping cycle, the peak load on the rod becomes less than a desired minimum load on the rod, then the master controller will send a signal to the motor controller 16 to disengage motor operation and set an alarm indicating that a broken pump rod is present. In addition, the motor can be stopped if a stuck traveling valve is sensed by determining that the difference between the minimum and the maximum rod load is smaller than a preset minimum, or the system can be disabled to protect a pump rod from damage if the load on the rod exceeds a maximum of a preset time limit. The system can even be used to determine the pump off condition and act as a pump off controller.

The invention described and claimed herein is not to be construed as limited to any particular embodiments described herein since these are to be regarded as illustrative rather than restrictive. The preset invention is intended to cover all configurations included within the spirit and scope of the appended claims.

1. A beam pumping unit for a well for continuously controlling the rate of fluid removal from the well, said unit comprising:

(a) a beam supported so that it can pivot;

(b) a rod string connected to said beam;

(c) a down hole pump with a full barrel level and a pump off level, said down hole pump connected to said rod string and reciprocated by said rod string and said beam;

(d) a pump motor connected to pivot said beam;

(e) a load transducer connected to said rod string to measure the load on said rod string;

(f) a position transducer connected to said beam to measure the position of said beam;

(g) a pump speed sensor to measure the pumping speed of the beam pumping unit;

(h) a microprocessor based controller that receives data from said load transducer, said position transducer, and said pump speed sensor; and (i) a variable speed motor controller connected to said pump motor to vary the speed of said pump motor in response to signals from said microprocessor based controller;

wherein said microprocessor based controller;

signals said variable speed motor controller to vary the motor speed that varies the pump speed of the beam pumping unit;

determines and stores a relationship between the power transferred to the rod string as a function of pump speed at a full barrel level for the first half of the down stroke of the rod string;

computes the power transferred to the rod string for the first half of each down stroke of the beam during operation of the beam pumping unit;

compares said power to said relationship; and signals said variable speed motor controller to vary the motor speed that varies the pump speed of the beam pumping unit according to said relationship whereby the rate of removal of fluid from the well is varied to maintain the fluid level in the well between the full barrel level and the pump off level.

2. In a beam pumping unit for a well for continuously controlling the rate of fluid removal from a well, said unit having a pumping motor connected to operate a beam pumping unit, means for varying the motor speed, the beam operable to reciprocate a rod string connected to a down hole pump, said pump having a pump barrel with a full barrel level and a pump off level, and a means for sensing the load on the rod, the position of the rod and the pump stroke speed, comprising in combination:

(a) means for determining and storing a relationship between the load on the rod as a function of pump speed at a full barrel condition for a portion of the stroke, said portion being limited to only the first half of the down stroke of the beam pump;

(b) computing means operable during pumping connected to the sensing means for receiving data therefrom and for computing on successive pump strokes the load on rod during said portion of successive strokes and sensing the pump stroke speed;

(c) means comparing said load to said relationship; and (d) means for varying the speed of the pumping unit in proportion to the difference between the computed load and the load stored in said relationship at the measured stroke speed whereby the rate of removal of fluid from said well is varied to thereby maintain said fluid level in said well below the full barrel level and above the pump off level.

3. In a beam pumping unit for a well for continuously controlling the rate of fluid removal from a well, said unit having a pumping motor connected to operate a beam pumping unit, means for varying the motor speed, the beam operable to reciprocate a rod string connected to a down hole pump, said pump having a pump barrel with a full barrel level and a pump off level, and a means for sensing the load on the rod, the position of the rod and the pump stroke speed, comprising in combination:

(a) means for determining and storing a relationship between the work performed by the beam pump as a function of pump speed at a full barrel condition for a portion of the stroke, said portion being limited to only the first half of the down stroke of the beam pump;

(b) computing means operable during pumping connected to the sensing means for receiving data therefrom and for computing on successive pump strokes the work performed by the beam pump during said portion of successive strokes and sensing the pump stroke speed;

(c) means comparing said computed work to said relationship; and (d) means for varying the speed of the pumping unit in proportion to the difference between the computed work and the work stored in said relationship at the measured stroke speed whereby the rate of removal of fluid from said well is varied to thereby maintain said fluid level in said well below the full barrel level and above the pump off level.

4. A method of operating a beam pumping unit for a well for continuously varying the rate of fluid removed from said well wherein said unit has a motor and means connected to operate a beam pumping means to vary said motor speed, said motor connects unit to reciprocate a rod string connected to a down hole pump, said pump having a pumping barrel with a full barrel level and a pump off level, and means for sensing the load on the rod, the position of the rod and the pumping speed, comprising in steps of:

(a) determining the relationship between the power transferred between the rod by the beam pump as a function of pumping speed at full barrel for a portion of the pump stroke, said portion being limited to only the first half of the down stroke of the beam pump (b) storing said relationship;

(c) computing during pumping the power transferred to the rod by the beam pump during said portion of the stroke, and sensing the pump stroke speed;

(d) comparing said computed power to said relationship;

(e) varying the speed of the pumping unit proportionally to the difference between the computed power and the power contained in said relationship at the measured stroke speed whereby the rate of removal of fluid from said well is varied to maintain said fluid level in said well below the full barrel level and above the pump off level.

5. A method of operating a beam pumping unit for a wel for continuously varying the rate of fluid removed from said well wherein said unit has a motor and means connected to operate a beam pumping means to vary said motor speed, said motor connects unit to reciprocate a rod string connected to a down hole pump, said pump having a pumping barrel with a full barrel level and a pump off level, and means for sensing the load on the rod, the position of the rod and the pumping speed, comprising in steps of:

(a) determining the relationship between the load on the rod as a function of pumping speed at full barrel for a portion of the pump stroke, said portion being limited to only the first half of the down stroke of the beam pump (b) storing said relationship;

(c) computing during pumping the load on the rod during said portion of the stroke, and sensing the pump stroke speed;

(d) comparing said computed load to said relationship;

(e) varying the speed of the pumping unit proportionally to the difference between the computed load and the load contained in said relationship at the measured stroke speed whereby the rate of removal of fluid from said well is varied to maintain said fluid level in said well below the full barrel level and above the pump off level.

6. A method of operating a beam pumping unit for a well for continuously varying the rate of fluid removed from said well wherein said unit has a motor and means connected to operate a beam pumping means to vary said motor speed, said motor connects unit to reciprocate a rod string connected to a down hole pump, said pump having a pumping barrel with a full barrel level and a pump off level, and means for sensing the load on the rod, the position of the rod and the pumping speed, comprising in steps of:

(a) determining the relationship between the work performed by the beam pump as a function of pumping speed at full barrel for a portion of the pump stroke, said portion being limited to only the first half of the down stroke of the beam pump (b) storing said relationship;

(c) computing during pumping the work performed by the beam pump during said portion of the stroke, and sensing the pump stroke speed;

(d) comparing said computed work to said relationship;

(e) varying the speed of the pumping unit proportionally to the difference between the computed work and the work contained in said relationship at the measured stroke speed whereby the rate of removal of fluid from said well is varied to maintain said fluid level in said well below the full barrel level and above the pump off level.

7. In a beam pumping unit for a well for continuously controlling the rate of fluid removal from a well, said unit having a pumping motor connected to operate a beam pumping unit, means for varying the motor speed, the beam operable to reciprocate a rod string connected to a down hole pump, said pump having a pump barrel with a full barrel level and a pump off level, and a means for sensing the load on the rod, the position of the rod and the pump stroke speed, comprising in combination:

(a) means for determining and storing a relationship between the power transferred between the rod and the beam pump as a function of pump speed at a full barrel condition for a portion of the stroke, said portion being limited to only the first half of the down stroke of the beam pump;

(b) computing means operable during pumping connected to the sensing means for receiving data therefrom and for computing on successive pump strokes the power transferred between the rod and beam pump during said portion of successive strokes and sensing the pump stroke speed;

(c) means comparing said computed power to said relationship; and (d) means for varying the speed of the pumping unit in proportion to the difference between the computed power and the power stored in said relationship at the measured stroke speed whereby the rate of removal of fluid from said well is varied to thereby maintain said fluid level in said well below the full barrel level and above the pump off level.

8. The combination of claim 7 wherein said fluid level in said well is maintained at a level that approaches but does not exceed the full barrel level.

9. The combination of claim 7 wherein said means for sensing the load on the rod comprises a load transducer.

10. The combination of claim 7 wherein said means for sensing the position of the rod comprises a position transducer.

11. The combination of claim 7 wherein said means for sensing the pump stroke speed comprises a pump stroke speed sensor.

12. The combination of claim 7 wherein said means for determining and storing a relationship between the power transferred between the rod and the beam pump as a function of pump speed at a full barrel condition for a portion of the stroke comprises a microprocessor based controller.

13. The combination of claim 7 wherein said computing means operable during pumping comprises a microprocessor based controller.

14. The combination of claim 7 wherein said means for comparing said computed power to said relationship comprises a microprocessor based controller.

15. The combination of claim 7 wherein said means for varying the speed of the pumping unit in proportion to the difference between the computed power and the power stored in said relationship at the measured stroke speed comprises a variable speed motor controller.

* * * * *

UNITED STATES PATENT AND TRADEMARK OFFICE

CERTIFICATE OF CORRECTION

PATENT NO. : 5,044,888

DATED : September 3, 1991

INVENTOR(S) : Hensley

It is certified that error appears in the above-identified patent and that said Letters Patent is hereby corrected as shown below:

On the Title page, In the Abstract:

Line 4, change "ths" to read --the--.

Column 8, line 17 change "method If" to read --method. If--.

Signed and Sealed this

Sixth Day of April, 1993

*Attest:*

STEPHEN G. KUNIN

*Attesting Officer*

*Acting Commissioner of Patents and Trademarks*